United States Patent [19]

Kraus

[11] 4,011,597

[45] Mar. 15, 1977

[54] BATHER'S CAP AND METHOD OF MAKING THE SAME

[76] Inventor: Friedrich Kraus, Lieschingstrasse 1, 7000 Stuttgart, Germany

[22] Filed: Aug. 30, 1974

[21] Appl. No.: 502,009

[30] Foreign Application Priority Data

Aug. 31, 1973 Germany ..... 2343881
June 27, 1974 Germany ..... 2430837

[52] U.S. Cl. ..... 2/68

[51] Int. Cl.[2] ..... A42B 1/12

[58] Field of Search ..... 2/68, 174, 178, 171, 2/175, 185 R, 195, 198

[56] References Cited

UNITED STATES PATENTS 1,491,258 4/1924 Gluckin ..... 2/68
1,552,459 9/1925 Szold ..... 2/68
1,997,708 4/1935 Uriwal ..... 2/178

FOREIGN PATENTS OR APPLICATIONS 1,945,911 3/1970 Germany ..... 2/68

*Primary Examiner*—H. Hampton Hunter
*Attorney, Agent, or Firm*—Michael J. Striker

[57] ABSTRACT

A bather's cap includes a cap body provided on its outer side with at least one hollow mounting plug integral with the cap body and having an enlarged end. At least one ornamental component is mounted on the hollow mounting plug. The ornamental component is securely held in place between the enlarged end of the hollow mounting plug and the adjoining portion of the outer side of the cap body.

14 Claims, 10 Drawing Figures

Fig. 5
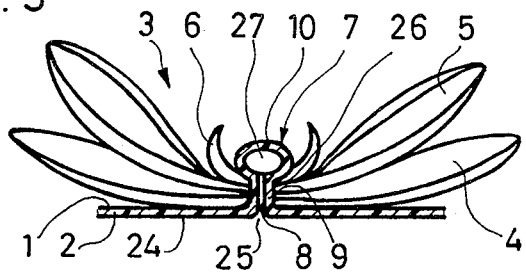
Fig. 6
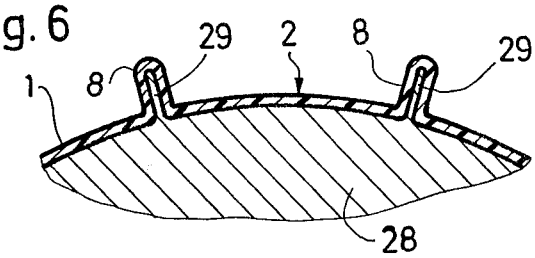
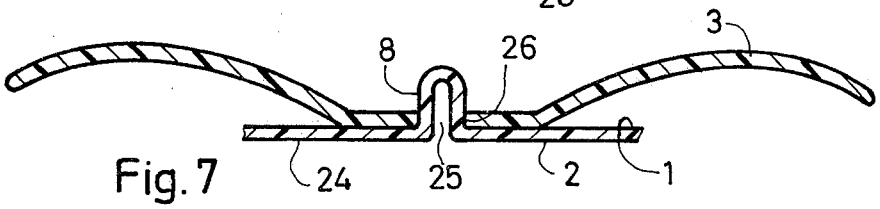
Fig. 7
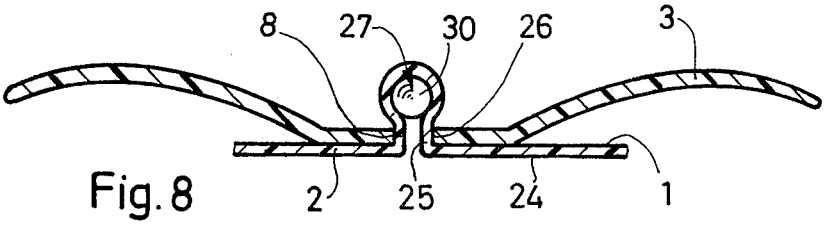
Fig. 8
Fig. 9
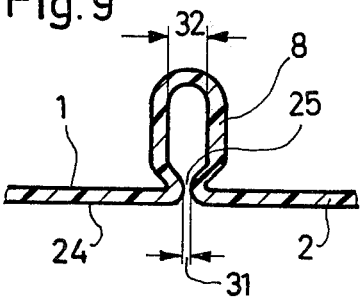
Fig. 10
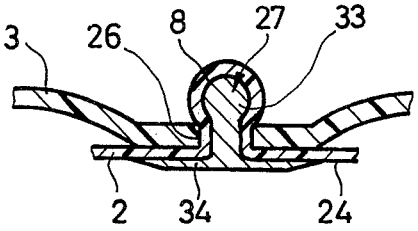

BATHER'S CAP AND METHOD OF MAKING THE SAME

BACKGROUND OF THE INVENTION

The invention relates to a bather's cap comprised of a cap body on whose exterior side there are arranged projections onto which ornamental components are mounted.

With known bather's caps of this type, the projections have the form of mounting plugs which are inserted into holes provided in thickened portions of the cap body, or else are formed solid and integral with the cap body, or else are formed with a mushroom-like head.

Such cap bodies must be produced by means of casting or injection-molding, and this manner of production requires expensive forms and machines and necessitates the use of materials whose elastic characteristics, because they must be made suitable for the production technique, are not necessarily optimal for the finished bather's cap itself. The mounting of the ornamental components on the projections of the cap body is difficult, and the projections in general require the use of extra attachments for securing the ornamental components on the projections. If the mounting projections are not to be supplemented with extra mounting components, they must be made of especially stiff material; as a result, the pushing of the ornamental components onto the mounting projections and into proper position requires considerable effort, and the resulting holding action is not particularly strong or reliable.

SUMMARY OF THE INVENTION

It is an object of the invention to provide a bather's cap of such a design that it can be produced using a very simple form.

It is another object to provide a bather's cap which can be made of light-weight and very elastic material.

It is a further object to provide a bather's cap of such a design that the ornamental components which are to be mounted on the outside of the cap can be mounted easily, quickly and in a reliable manner.

These objects, and others which will become more understandable from the description, below, of preferred embodiments, can be met, according to one advantageous concept of the invention, by providing the mounting projections on the outside of the bather's cap in the form of hollow mounting plugs having enlarged end portions. The hollow construction of the mounting plugs makes possible, on the one hand, simple production of the cap body using very simple forms and, on the other hand, very easy mounting of the ornamental components.

According to one advantageous concept of the invention, the hollow mounting plug has an enlarged end portion constituting a head provided at the end of a small neck portion. The head has a greater wall thickness than the remainder of the cap body, so that it exhibits high stability, in order to fixedly hold in place the ornamental component by means of a sort of snap action. Particularly advantageously, the outer diameter of the neck of the mounting projection is about half the outer diameter of the head. The wall thickness of the head can be between about 1 and 2 mm if the remainder of the cap body has a wall thickness of about 0.6 mm. In order that the ornamental components not lie completely flat on the exterior surface of the cap body and no special support body be required, it is particularly advantageous to surround the projections with raised portions, most advantageously in the form of circumferential walls. When the ornamental components are then mounted onto the hollow mounting plugs, the circumferential projecting walls surrounding the mounting plugs force portions of the ornamental components outwards away from the surface of the cap body, thereby increasing the three-dimensionality of the ornamental components.

The bather's cap can be assembled with great ease, according to one advantageous concept of the invention, by employing the following method. A negative form is employed for producing the cap body with the hollow mounting plugs. The negative form is first filled with fluid material which forms a coating on the surface of the form after the elapse of a certain coating time, whereafter the still liquid portion of the material is poured off. After the layer on the surface of the form has cured or set, it is removed from the form and constitutes the cap body. Support members are inserted into the hollow mounting plugs, and the ornamental components, after application of a lubricating material, are pushed onto the hollow mounting plugs, after which the support members are removed. By means of the support members the hollow mounting plugs are stretched for the mounting of the ornamental components, so that the diameter of the head of the mounting plug decreases. For the lubricating material use is preferably made of a soap solution. The accumulation of material in the region of the head of the plug can in particular be achieved by maintaining the corresponding portion of the form at a higher temperature than the remaining portions of the form, i.e., so that the curable material forms a thicker layer at such higher-temperature portions.

According to another advantageous concept of the invention, the end portions of the hollow mounting plugs are enlarged by pushing into the interior of the mounting plugs anchoring members which stretch the material of the end portions of the mounting plugs. One advantageous possibility is to start with a cap body which is smooth, i.e., not provided with hollow mounting plugs, and to then form the mounting plugs simultaneously with the mounting of the ornamental components on the mounting plugs. This can be accomplished by positioning the material of the cap body intermediate the mounting opening of the ornamental component and an anchoring member. The anchoring member is then pushed through the opening of the ornamental component, taking along with it the intermediate material of the cap body and thus distending the material of this portion of the cap body to form from this portion of the cap body the hollow mounting plug. However, it is particularly advantageous to provide the cap body with the hollow mounting plugs by other means, such that the mounting plugs exist in the cap body itself before attachment of the ornamental components.

Advantageously, such a cap body with hollow mounting plugs with uniform wall thicknesses likewise can be produced in a simple manner according to the invention, in particular by dipping a prong-covered positive form into a bath of curable material, especially latex, and after the elapse of a certain coating time removing the form from the bath. After the coating which has formed on the surface of the form cures or sets, it is removed from the form and constitutes the cap body.

The cost of the form is very low, and the bather's cap can be made thin and of light weight.

When the hollow mounting plugs are formed from an initially smooth cap body, for example using the anchoring members referred to above, there accrues the advantage that the ornamental components can be located at any desired position on the surface of the cap body; conversely, a particular cap body can be provided with any desired arrangement of one or more ornamental components. On the other hand, when the mounting plugs are formed as permanent projections, for example by use of a positive or negative form having recesses or prongs for the formation of such projections in the cap body itself, there is the advantage that folds do not form in the cap body and no additional elastic restoring forces are exerted on the material of the cap body when the bather's cap is completely assembled.

According to a further advantageous concept of the invention, in the case of molded hollow mounting plugs, the diameter of the opening of the hollow mounting plug at the interior side of the cap body is smaller than the inner diameter of the rest of the mounting plug. In this way, openings hardly larger than needle stitches are visible at the interior side of the cap body, avoiding the aesthetically displeasing effect of larger openings.

The anchoring member is advantageously made of synthetic plastic and has an oblong or spherical form. It can also have the shape of a snap fastener, with its head being pushed through the mounting opening in the ornamental component and with its foot portion completely closing off the opening of the hollow mounting plug at the inner side of the cap body.

The ornamental component can be composed of different individual parts, for example flower-shaped or leaf-shaped parts made of flat textile-like material, textured textile-like material, rubber or synthetic plastic. That one of the parts of the ornamental component which is located furthest from the outer surface of the cap body is advantageously made of a relatively stiff snythetic plastic, for example polyethylene, so that together with the enlarged end portion of the mounting plug a more secure holding action is achieved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 5 is a section taken on line II—II of FIG. 1, but illustrating a different manner of attaching an ornamental component to the bather's cap;

FIG. 6 is a section through a part of a prong-covered positive form showing part of a bather's cap cap body in situ on the form;

FIG. 7 is a view corresponding to FIG. 5, but with the anchoring member 27 removed;

FIG. 8 is a view corresponding to FIG. 7 but with the anchoring member 27 in place;

FIG. 9 is a section through one examplary hollow mounting plug; and

FIG. 10 is a section corresponding to that of FIG. 2, but of a different embodiment of the invention.

DESCRIPTION OF THE PREFERRED EMBODIMENTS

Figure 1:
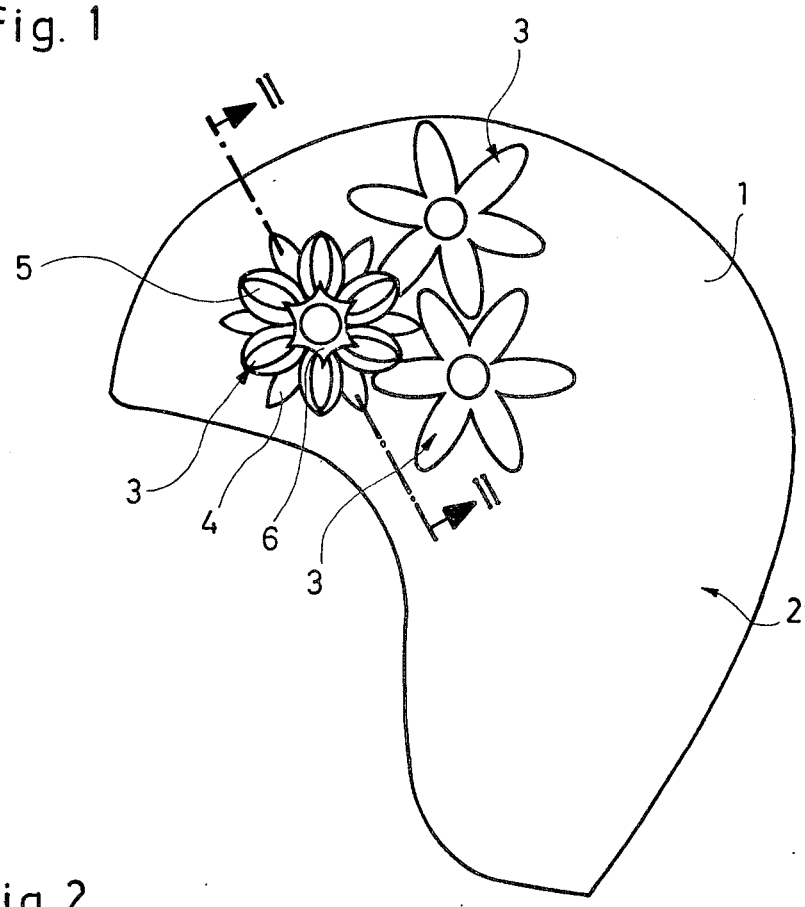
FIG. 1 is a side view of a bather's cap with only partially mounted ornamental components.
Figure 2:
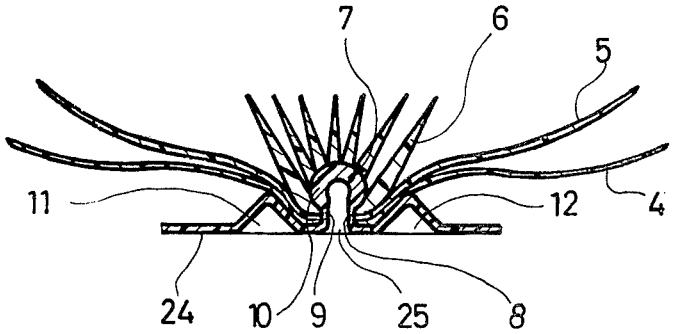
FIG. 2 is a section taken on line II—II in FIG. 1.
Figure 3:
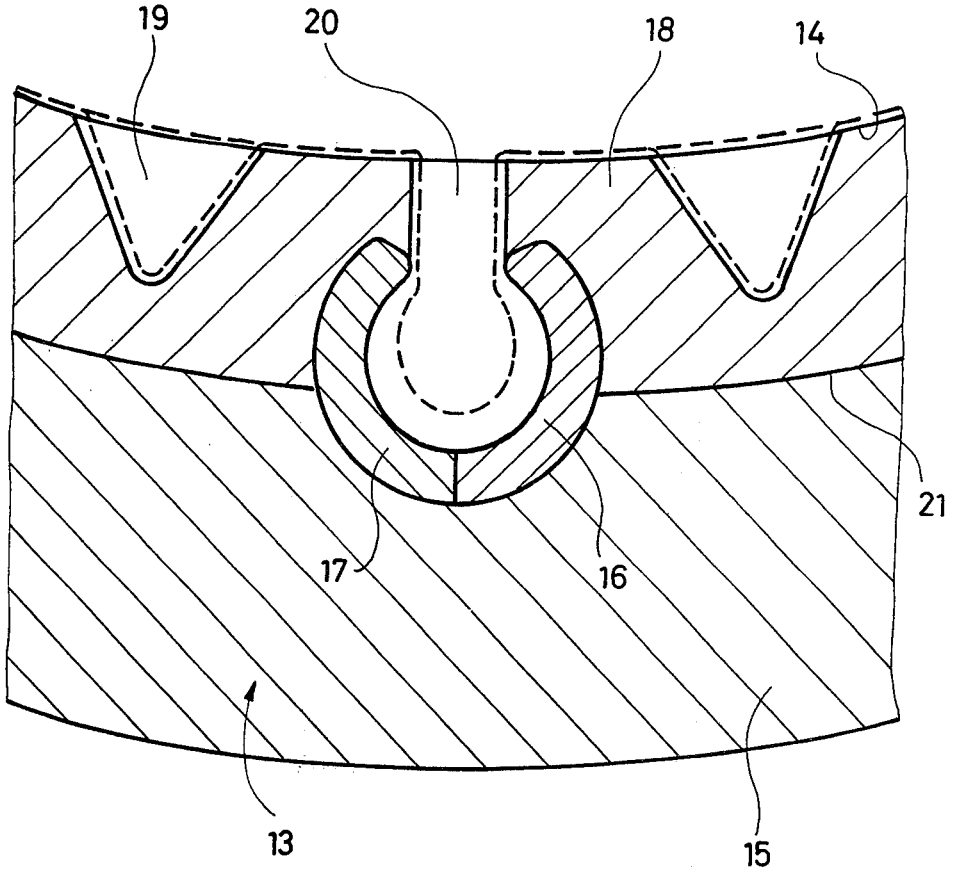
FIG. 3 is an enlarged sectional view of part of a negative form used for making a cap body.
Figure 4:
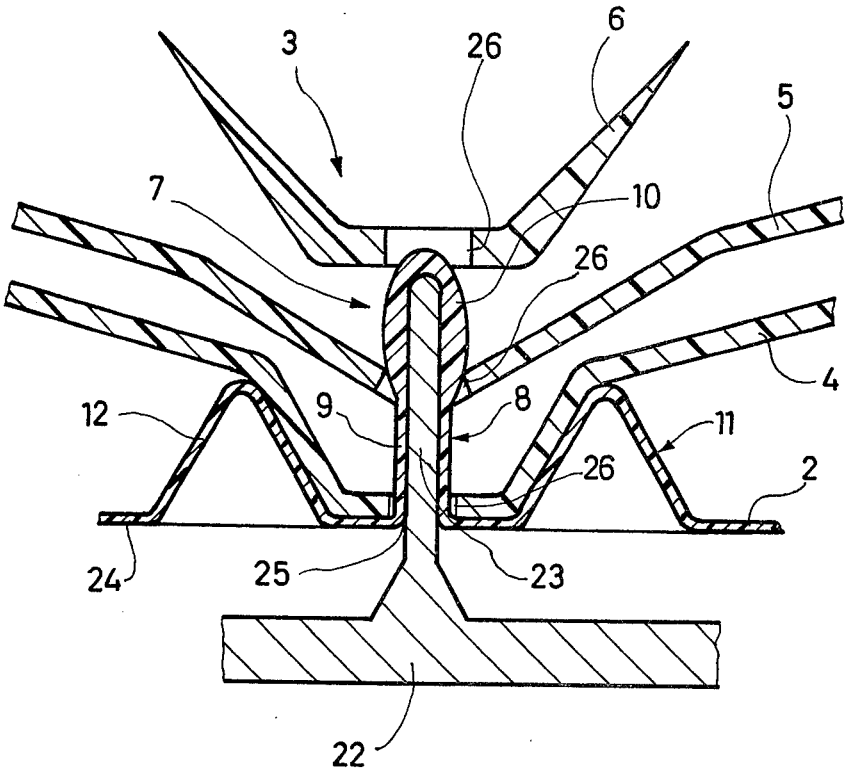
FIG. 4 is a section through a part of a bather's cap during the attachment of the ornamental component to the cap.

The embodiments of FIGS. 1–4 will be discussed first. Reference numberal 2 generally designates the cap body of a bather's cap. Mounted on the outer side 1 of the cap body 2 are a plurality of ornamental components 3. These ornamental components may for example be comprised of two rubber parts 4, 5 and a synthetic plastic part 6 which when assembled together have the general appearance of a flower. The cap body 2 is advantageously made of latex and is provided on its outer side 1 with projections 7 configurated as hollow mounting plugs 8 having enlarged ends, so that each mounting plug 8 has a neck 9 and a head 10.

Whereas the cap body 2 in general has a thickness of 0.6 mm, the head 10 in comparison with the neck 9 is enlarged not only with respect to its external diameter, but additionally has a wall thickness of about 1 to 2 mm, so that the head 10 will have considerable stiffness and rigidity. Surrounding each projection 7 there are arranged elevated portions 11 forming a closed wall 12 in the middle of which the hollow mounting plug 8 is located.

To produce such a cap body 2, use is advantageously made of a negative form 13 (FIG. 3) into which the latex material is poured. On the wall 14 of the form 13 there forms a layer which remains in the form 13 when after a certain time interval the still fluid portion of the latex material is shaken out of the form 13. Upon elapse of a short setting or curing time interval, the layer can be removed from the form 13 and will constitute the cap body 2. The portion of the form 13 which surrounds the head 10 of the hollow mounting plug 8 has a higher temperature than the other portions of the form, resulting in an increased wall thickness for the head 10. To this end, half shells 16, 17 can be inserted into a carrier member 15, with the half shells 16, 17 being maintained at a higher temperature than the form layer 18 arranged on the inner side 21 of the carrier 15. The form layer 18 is provided with cavities 19 for the formation of the walls 12 (FIG. 12), and is further provided with openings 20 for the necks 9 of the hollow mounting plugs 8. The openings 20, the elasticity of the material employed and the wall thickness of the head 10 are so matched to each other that the cap body 2 can be readily removed from the form 13 by simply exerting a slight pull.

To mount the ornamental components 3 on the cap body 2, in the embodiment of FIGS. 1–4, use is made of a device 22 (FIG. 4) comprised of a bar-shaped support body 23 which from the inner side 24 of the cap body 2 is inserted into the opening 25 in the hollow mounting plug 8. The cap body 2 is pulled downwardly, and likewise the hollow mounting plug 8, causing the diameter of the head 10 to decrease, so that the rubber parts 4, 5 and the synthetic plastic part 6 with their openings 26 can now be readily pushed down past the head 10 onto the neck 9 of the hollow mounting plug 8, after a lubricating substance, particularly a soap solution, has been applied. When the snythetic plastic member 6 is correctly positioned, then the support body 23 is pulled out from the interior of the hollow mounting plug 8. The head 10 reassumes its original configuration, so as to establish a secure mounting of the parts 4, 5 and 6 by blocking the path of removal of the parts 4, 5 and 6.

By means of the wall 12 and the configuration of the synthetic plastic member 6, the petal-like portions of the rubber parts 4, 5 are caused to a certain extent to bend up and away from the surface of the cap body 2, thereby increasing the three-dimensionality of the appearance of the ornamental component 3. The rubber parts 4 and 5 could alternatively be made of textile, synthetic plastic or another type of material.

In the embodiments of FIGS. 5–10, the enlargement of the end of the hollow mounting plug 8 is achieved by means of a specially provided anchoring member 27. The member 27 is pushed from the inner side 24 of the cap body 2 through the opening 25 into the interior of the hollow mounting plug 8. When the member 27 is pushed all the way into the interior of plug 8, it imparts to the surrounding portion of the plug its diameter, which is greater than the diameter of the neck 9 of the plug 8.

In the embodiment of FIG. 5, the hollow mounting plug 8 is formed from an initially smooth cap body 2, by pushing the anchoring member 27, from the inner side 24 of the cap body 2, against the adjoining portion of the material of the cap body 2, through the opening 26 of the ornamental component 3 located adjacent the outer side of the cap body 2. In this event, the member 27 and the opening 26 in the ornamental component 3 are both advantageously of oblong shape, so that the member 27 can be pushed through the opening 26, by reason of being oriented parallel to the opening 26, and then twisted to lie transverse to the opening 26, thereby establishing secure locking action.

In the embodiments of FIGS. 3–6 the hollow mounting plugs 8 are again molded into the material of the cap body 2. Use is made in this case of a positive form 28 having prongs 29. The form 28 is dipped into a bath of liquefied material, in particular latex. After a short time, a layer forms on the surface of the form. After the form is withdrawn from the bath, and upon elapse of a certain curing or setting time interval, this layer can be pulled off the form 28 and constitutes the cap body 2. The ornamental components 3, which in these embodiments are for example unitary members made of synthetic plastic material, can without any great effort be pushed onto the thusly configurated hollow mounting plugs 8. Thereafter, an anchoring member 27, for example a spherical member 30 is pushed from the inner side 24 of the cap body 2 through the opening 26 of the ornamental component 3 into the interior of the hollow mounting plug 8. As the spherical member 30 is pushed into the interior of the hollow mounting plug 8, the material of the cap body 2 which surrounds the entrance of the hollow mounting plug 8 is stretched. However, as the spherical member 30 is pushed all the way into the end of the mounting plug 8, the material of the cap body 2 contracts to its original shape and size, thereby establishing a secure anchoring of the ornamental component 3 on the cap body 2.

In order that the opening 25 at the inner side 24 of the cap body 2 not present an unaesthetic appearance, the configuration of the hollow mounting plug 8 is advantageously designed in the manner depicted in FIG. 9. The diameter 31 of the opening 25 is kept especially small, in every case smaller than the inner diameter 32 of the hollow mounting plug 8.

As a further possibility, the anchoring member 27 can have the form of a press fastener, as depicted for example in FIG. 10. The head 33 of the press fastener then serves for the secure anchoring of the ornamental component 3, whereas the foot 34 of the press fastener completely covers the opening 25.

It will be understood that each of the elements described above, or two or more together, may also find a useful application in other types of constructions and methods differing from the types described above.

While the invention has been illustrated and described as embodied in bathing caps and methods for their manufacture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bather's cap comprising, in combination, a cap body provided on its outer side with at least one elastic hollow mounting plug integral with said cap body and having an enlarged end constituting a head integrally joined to the adjoining portion of said cap body by a neck of a cross-section smaller than that of said enlarged end, and at least one ornamental component having an opening of a predetermined cross-section smaller than the maximum cross-section of said enlarged end with said neck of said plug extending through said opening whereby said ornamental component is mounted on said cap between said enlarged end of said mounting plug and said adjoining portion of said cap body.

2. A bather's cap as defined in claim 1, wherein said head has a greater wall thickness than the remainder of said cap body.

3. A bather's cap as defined in claim 2, wherein the outer diameter of said head is approximately twice the outer diameter of said neck.

4. A bather's cap as defined in claim 2, wherein the wall thickness of said head is between about 1 mm and about 2 mm.

5. A bather's cap as defined in claim 1, wherein the surface of said cap body surrounding said at least one hollow mounting plug is provided with an elevated portion at least partially surrounding said hollow mounting plug.

6. A bather's cap as defined in claim 5, wherein said elevated portion forms a circumferential wall surrounding said hollow mounting plug and having a center occupied by said hollow mounting plug.

7. A bather's cap as defined in claim 1, wherein said hollow mounting plug is provided with an anchoring member occupying the innermost position in the interior of said hollow mounting plug and having dimensions such as to stretch the material of said plug at said end portion thereof to cause said end of said plug to be enlarged.

8. A bather's cap as defined in claim 7, wherein said holding member is of oblong shape.

9. A bather's cap as defined in claim 1, wherein said hollow mounting plug at the region thereof closest to said cap body at the inner side of said cap body has an opening constituting an entrance into the hollow interior of said hollow mounting plug, and wherein the inner diameter of said opening is smaller than the inner diameter of the remainder of the hollow interior of said hollow mounting plug.

10. A bather's cap as defined in claim 7, wherein said anchoring member is spherical.

11. A bather's cap as defined in claim 1, wherein said hollow mounting plug is provided with an anchoring member completely filling the interior of said hollow mounting plug and having an enlarged end portion causing the end portion of said hollow mounting plug to be enlarged and having a foot portion closing off the interior of said hollow mounting plug at the interior side of said cap body.

12. A bather's cap as defined in claim 1, wherein said ornamental element surrounds said mounting plug and projects with portions thereof away from said cap body beyond said cap.

13. A bather's cap as defined in claim 1, wherein said ornamental element is at least with a portion thereof about said opening formed from elastically stretchable material.

14. A method of forming a bather's cap, comprising the steps of first positioning a portion of the cap body of a bather's cap intermediate an anchoring member and an ornamental component having an expandable mounting opening, with the anchoring member adjoining the interior side of the cap body and the ornamental component adjoining the exterior side of the cap body; and subsequently pushing the anchoring member and the material of the adjoining portion of the cap body through said mounting opening, while stretching and deforming the material of said portion of the cap body by manipulation of said anchoring member to cause the material of said portion to form a hollow mounting plug having an enlarged end which securely holds said ornamental component against the exterior side of the cap body.

* * * * *